US006102404A

United States Patent [19]

Barker

[11] Patent Number: 6,102,404

[45] Date of Patent: Aug. 15, 2000

[54] TARGET TRIGGERED DOUSING ASSEMBLY

[76] Inventor: Mark Francis Barker, W5896 Birch Creek Rd., Menominee, Mich. 49858

[21] Appl. No.: 09/288,434

[22] Filed: Apr. 8, 1999

[51] Int. Cl.[7] ..... F41J 5/00

[52] U.S. Cl. ..... 273/385; 273/379; 273/381; 273/384

[58] Field of Search ..... 273/378, 379, 273/381–387, 440

[56] References Cited

U.S. PATENT DOCUMENTS

| | | | |
|---|---|---|---|
| 866,222 | 9/1907 | Ripley | 273/385 |
| 1,021,019 | 3/1912 | Van Kannel . | |
| 1,413,770 | 4/1922 | Palaith . | |
| 2,202,738 | 5/1940 | Keller | 273/102.1 |
| 4,093,228 | 6/1978 | Pierce | 273/102.1 G |
| 4,466,616 | 8/1984 | Griego et al. | 273/384 |
| 4,702,480 | 10/1987 | Popeski et al. | 273/384 |
| 4,943,064 | 7/1990 | Smith | 273/384 |
| 5,087,054 | 2/1992 | O'Neil | 273/384 |
| 5,839,981 | 11/1998 | Rudell | 273/384 |
| 5,848,793 | 12/1998 | Celis | 273/384 |
| 5,947,476 | 9/1999 | Rousay | 273/384 |

*Primary Examiner*—Mark S. Graham
*Attorney, Agent, or Firm*—Loyd W. Bonneville, Attorney

[57] ABSTRACT

A target triggered dousing assembly wherein an operator throws a bean bag or other missile at a triggering target which in turn moves to allow a hammer to strike a bell and tug upon a lanyard, tipping a dousing bucket to dispel its contents upon a participating subject below.

9 Claims, 3 Drawing Sheets

TARGET TRIGGERED DOUSING ASSEMBLY

BACKGROUND OF THE INVENTION

1. Field of the Invention

Social Amusements; Entertainment Devices

2. Description of the Prior Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term tipping access window (27) might be used in one instance but in another, if meaning is otherwise clear from context, expression might be shortened to access window (27) or merely window (27). Any of those forms is intended to convey the same meaning.

The term emplace or any of its forms when used in this application means the joining of two objects or parts so as to unite them in a reasonably easily removable way, such as the positioning of a tripping pin (12) onto a tripping pin rest (12) from which it (12) may be removed, discussed ante.

Where the term is employed, rigid emplacement connotes the meaning that the object is removable but only with some degree of difficulty, such as might be encountered in separating two parts—for example, the end of a lanyard (7) through a lanyard tether (9) in which it (7) is held in place by knotting.

The word emplace is also consistent in meaning with the word "detachable" as occasionally used in connection parlance but not in this application, since it is derived from the root attach. The term attach or fasten or any of their forms when so used means that the juncture is of a more or less permanent nature, such as might be accomplished by nails, screws, welds or adhesives. Employment of the words connect or join or any of their forms is intended to include the meaning of both in a more general way.

The word comprise may be construed in either of two ways herein. A generic term used to describe a given one of a number of specific elements is said to comprise it, thereby characterizing the specific element with equivalency in meaning for the generic term. Thus, a lanyard tether (9) may be said to comprise an eyelet (91), meaning that in the particular case, the lanyard tether (9) is an eyelet (91). However, the word comprise may also be used to describe a feature which is part of the structure or composition of a given element. Thus, a hammer (11) may be said to comprise a tripping pin (12), meaning that the structure of the hammer (11) is such as to have the tripping pin (12) as a feature of its structure. The meaning in the respective cases is clear from context, however. Accordingly, modifying words to clarify which of the two uses is the intended one seem unnecessary.

There is a domain of entertainment which is limited, more or less, to picnics and certain parties. One socially acceptable form of such entertainment involves one's splashing water or perhaps an even more innocuous substance upon another person. Over the decades, various devices have been constructed which either dunk a waiting subject or douse him or her. While water has been the traditional substance of delivery—and many bathing suited contenders would be anxious to offer themselves to that end—confetti may be more humanely employed. Whatever the vehicle for mirth one might choose—water or confetti—certain specific objectives or needs have thereby made themselves known even in this sector of today's world.

To meet the needs of economy and simplicity associated with such entertainment, the target triggering device should feature a low impact tripping mechanism employing gravity as an actuating force rather than complex mechanical linkages requiring a high impact trigger or bulky levered linkages.

U.S. Pat. No. 1,021,019 issued to Van Kannel, U.S. Pat. No. 1,413,770 issued to Palaith, U.S. Pat. No. 2,202,738 issued to Keller, U.S. Pat. No. 4,466,616 issued to Griego, U.S. Pat. No. 4,943,064 issued to Smith and U.S. Pat. No. 5,087,054 issued to O'Neil all feature dunk tank devices which cause a person or dummy to become emersed into a lank of water upon a missile's impact with a triggering target physically linked to remove the subject's supporting mechanism.

U.S. Pat. No. 4,093,228 issued to Pierce comprises an overhead water dousing bucket overturned upon a finger's target triggered mechanical removal of a lanyard loop from a restraining pin.

U.S. Pat. No. 4,702,480 issued to Popeski depicts an overhead toilet, the flushing control of which has connected to it a long weighted lever restrained from actuation until released by mechanical linkage with the triggering target.

The needs or objectives pointed out suprathus far remain only partly addressed in the prior art. Some have not been met at all.

SUMMARY OF THE INVENTION

The invention is a recreational dousing apparatus for use at picnics or other entertainment events. It provides means by which an operator (100) may, upon tossing a bean bag or other missile (102) upon a target, cause a dousing bucket (21) to dispel its contents (103) upon a passively participating subject (200) beneath it. The bean bag target may comprise any shape including that of a horizontally or frontally angularly disposed plate or tray (5) and may depict a bull's eye. It (5) is moveable so that it (5) causes a sufficiently heavy object (11) to be released from a suspended or held position and allowed to fall against and strike a bell (19).

The target's movement, on the one hand, may permit it to function as an electric switch which causes the second object's release by electromagnetic, other electronic or computerized means. On the other hand, the movement may comprise displacement through a distance which drives a properly configured part of it (2) against part of the second object (12), lifting it (12) off from a support or rest (14), acting much in the manner of a latch mechanism.

As the heavy object (11) falls, it tugs a lanyard (7), one end of which (7) is connected to it (11). The lanyard's (7) other end is connected to a dousing bucket (21) usually containing confetti. As the lanyard (7) is tugged, it causes the bucket (21) to tip, dispelling its contents (103) upon a subject (200), expectantly positioned below—most likely in seated fashion. The tipping of the bucket (21) is facilitated by emplacing it (21) in a pivotable disposition.

BRIEF DESCRIPTION OF THE DRAWINGS

Solid lines in the drawings represent the invention. Dashed lines represent prior art.

DESCRIPTION OF THE PREFERRED EMBODIMENT

Figure 1:
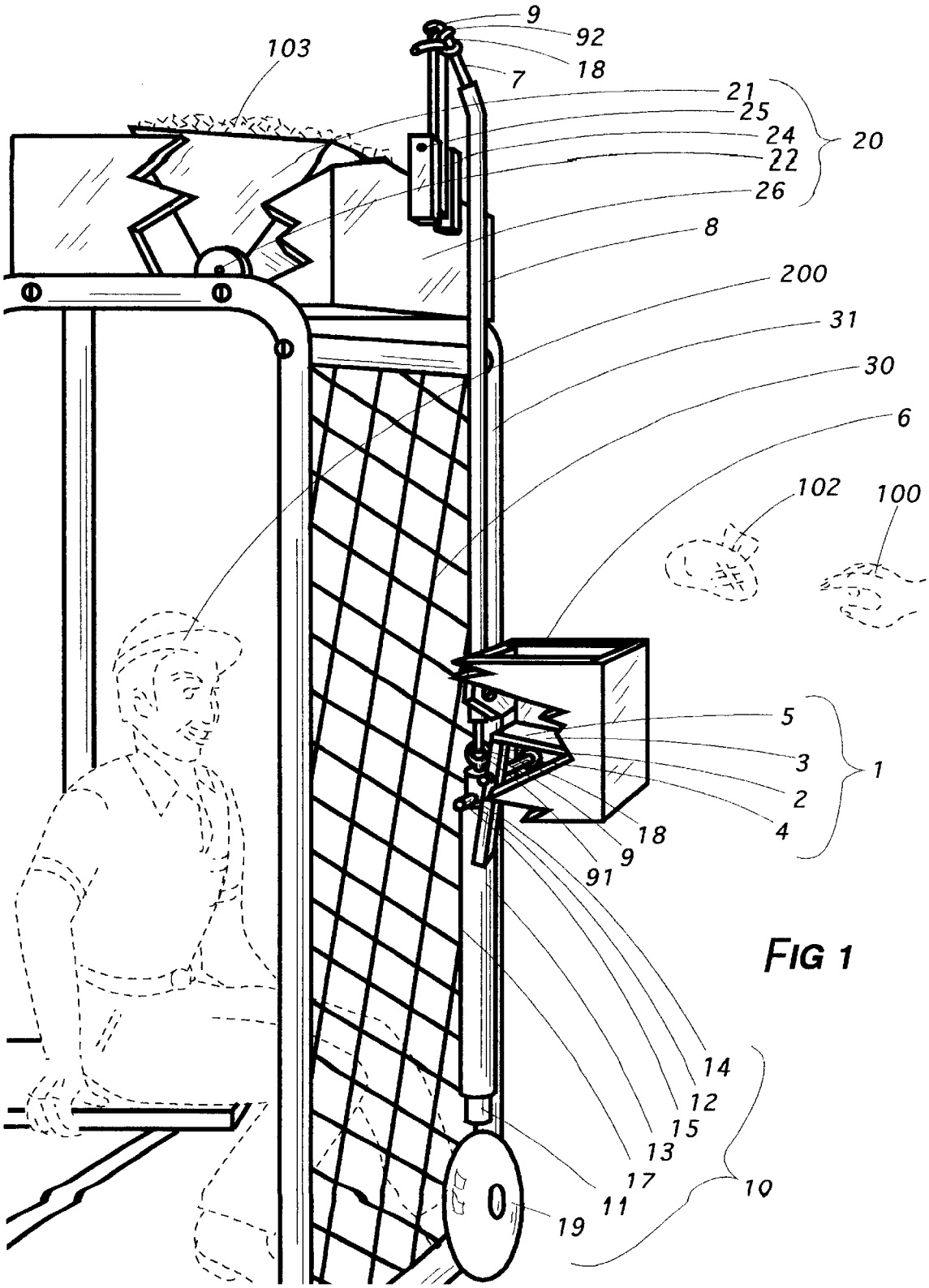
FIG. 1 represents a perspective partially cut-away view of an typical embodiment of the invention in which the target enclosure's (6) front side is open and opaque.

The invention comprises an assembly of objects mechanically connected to permit one (100) to toss or throw a missile (102) such as a bean bag against a target technically characterized herein as a missile impact site (3) and thereby ring a bell (19) and simultaneously cause a bucket (21) poised to do so to overturn and dump its contents upon—or douse—a typically seated subject (200) below. Certain parts of the invention are then manually reset to repeat such actuation.

In the main, the invention comprises a target assembly (1), a bell ringing assembly (10) and a dousing assembly (20).

The target assembly (1) comprises the missile impact site (3), a target tray (5) as well as pin tripping lever (2) rotatably disposed upon a tripping pivot (4), all of which are disposed within a target enclosure (6).

The bell ringing assembly (10) comprises a hammer (11) comprising in turn a tripping pin (12) and a bell (19). The hammer (11) is disposed within a hammer sleeve (13) upon the top of which (13) the tripping pin (12) lies prior to the assembly's (10) activation. The point on the sleeve (13) the pin (12) is so positioned is designated herein as a tripping pin rest (14). Also preferably disposed at that site (14) on the sleeve (13) are a tripping pin notch (15) and pin slide (16). This assembly (10) also comprises a tripping pin drop channel (17) vertically disposed and in general alignment with the bell (1 9) and a lanyard to hammer connection site (18) further discussed ante.

The dousing assembly (20) comprises a dousing bucket (21) rotatable upon a bucket pivot (22), a lanyard to bucket connection site (23) further discussed ante and a bucket tipping lever (24) rotatably disposed upon a tipping pivot (25). A tipping access window (27) also included as part of this assembly (20) provides an opening for the tipping lever (24) to pivot through freely.

The invention also comprises a lanyard (7)—essentially a line, cable or rope—and preferably, a lanyard sheath (8) which comprises a housing for the lanyard (7). One end of the lanyard (7) is tied to the hammer (11) disposed below, the other to the bucket tipping lever (24) above. The connections in both cases, preferably by knotting, are made at what are referred to herein as lanyard tethers (9). Such a tether (9) may be of any configuration known to prior art useful for the purpose but preferably comprises an eyelet (91) or an aperture (92) through either of which the lanyard (7) is inserted for interconnection.

As alluded to supra, an enthusiast—operator (100) herein—can activate the invention by tossing a missile (102)—say, a bean bag—at the target tray (5). If the missile (102) strikes it (5), the tray (5), comprising plate-like configuration, is in turn moved upon the tripping pivot (4), precipitating the chain of events addressed herein.

The tray (5) may be disposed in any given attitude, so long as its (5) movement when struck brings it (5) pivotably into contact with the tripping pin (12) in such manner as to dislodge the pin (12) from its rest (14). Thus, it may be disposed horizontally as illustrated in FIG. 2, vertically or at any angle in between. Preferably, however, for reasons further discussed ante, it (5) is disposed in frontal angularity—that is, tilted downward at an angle toward the operator (100) as shown in FIG. 1.

The pin tripping lever (2) is connected to the tray (5), preferably by attachment, and the tray (5) together with the lever (2), when disposed either horizontally or in frontal angularity, are balanced upon the tripping pivot (4). If the missile (102) lands upon a tray (5) so disposed, its (102) weight causes it (5) to rotate downward upon the pivot (4). The interconnection of the tray (5) and lever (2) is such that as the tray (5) so rotates, the tripping lever (2) connected to it (5) also rotates upon the pivot (4). Where the tray's (5) and lever's (2) plane of rotation is vertical—a preferred disposition—the lever's (2) rotation comprises an upward direction.

Figure 2:
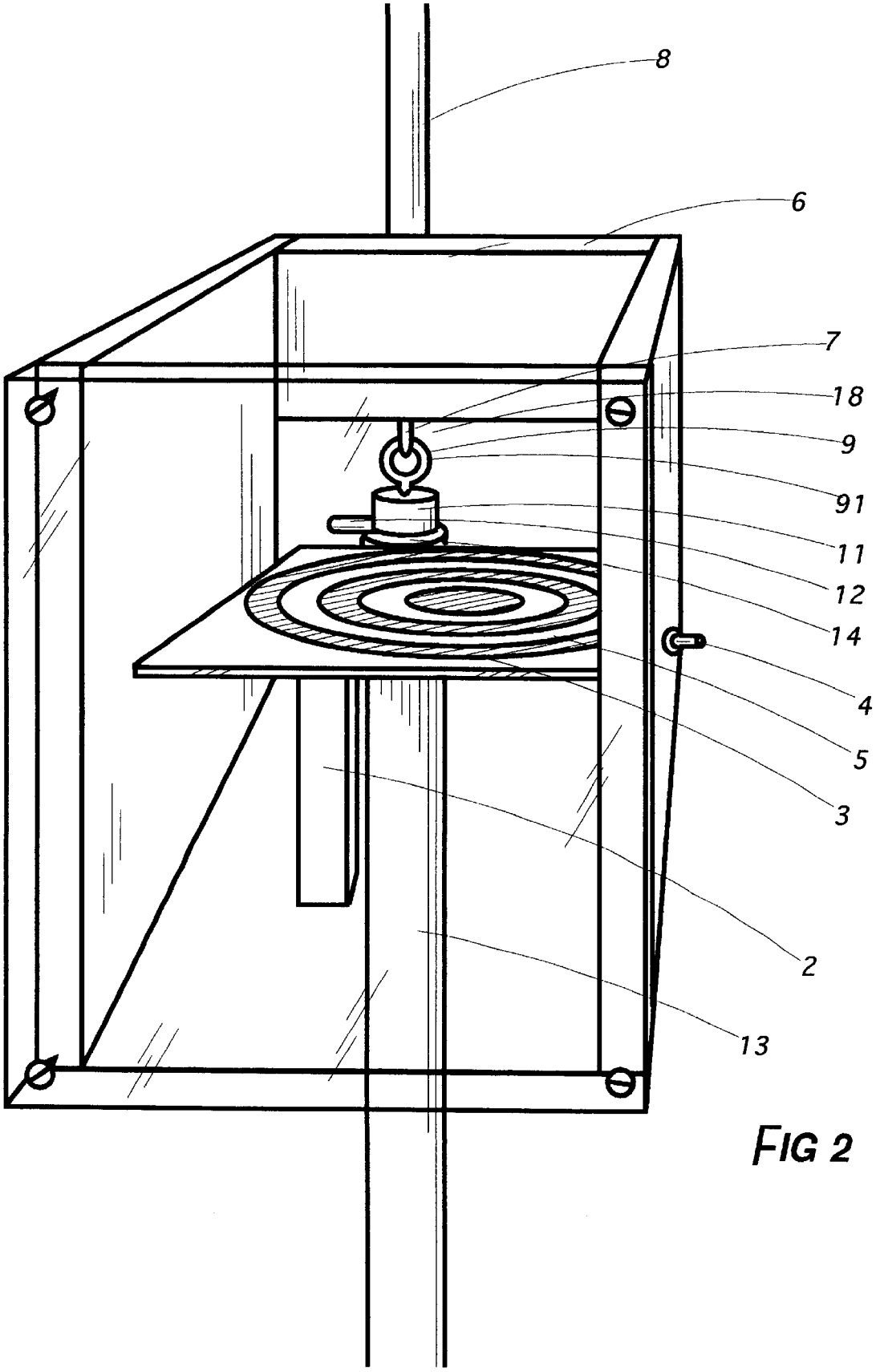
FIG. 2 depicts a perspective view in which the target tray (5) is constructed so that it attains balance in horizontal disposition rather than in a tilted frontal angular or any other one. The target enclosure's (6) front side is shown transparent in this embodiment.

Preferably, for the sake of manufacturing simplicity, the tray (5) and lever (2) merely comprise opposite ends of but a singular structure as shown in FIGS. 1 and 2 and it is, therefore, stated herein that the pin tipping lever (2) is preferably comprised by the tray (5).

Where the plane of rotation of the two (2, 5) is vertical, their configuration is such as to provide a delicate counterbalance. The balance may cause the target tray (5) to come to rest in generally horizontal disposition as shown in FIG. 2.

Both horizontal and frontally angular—that is, toward the operator (100)—downward slanting disposition of the tray (5) and lever (2) are preferred to a vertical one in that they benefit from gravitational assistance in causing the them (2, 5) to return to—that is, rock back to—their (2, 5) previous attitude following actuation. Either of those dispositions, thus, employs counterbalancing as a feature and it is not, therefore, required that they (2, 5) be reset for each instance of use.

Counterbalancing may be achieved by means well known to prior art such as by lengthening the lever (2) or adding weight to it (2). As mentioned supra, it is most preferable to dispose the tray (5) at rest in frontal angularity. Where the lever (2) extends from a tray (5) so tilted, as shown in FIG. 1, it (2) is brought in closer proximity to the tripping pin (12) it (2) is intended to engage and the arc of rotation—that is, the distance the lever (2) is required to move before dislodging the pin (12)—is shortened, ante.

As shown in FIG. 1, the tray (5) is more nearly disposed for frontally angular tilting by disposing the tripping pivot (4) at a point along the pin tripping lever (2) an inch or so away from its (2) junction with the tray (5). However, as mentioned supra, that effect may be compensated for merely by lengthening the lever (2) or adding weight to it (2).

Preferably, the target enclosure (6) is partially open on its rear side, as shown in FIG. 2, to allow for unrestricted movement of the pin tripping lever (2). Further, the enclosure's (6) front side—that nearest the operator (100)—is preferably closed in most of the invention's embodiments, adding to the challenge the operator (100) must meet to hit the target. If the front side of the enclosure (6) is left open, the target tray (5) might comprise an attractive bull's eye, supra. A bull's eye is also visible when present in embodiments in which the enclosure's (6) front side is transparent as in FIG. 2. A non-breakable material such as plastic is appropriate for such use. Screening or mesh material, such as that employed for the barrier (30) ante, may also be attached there.

Figure 3:
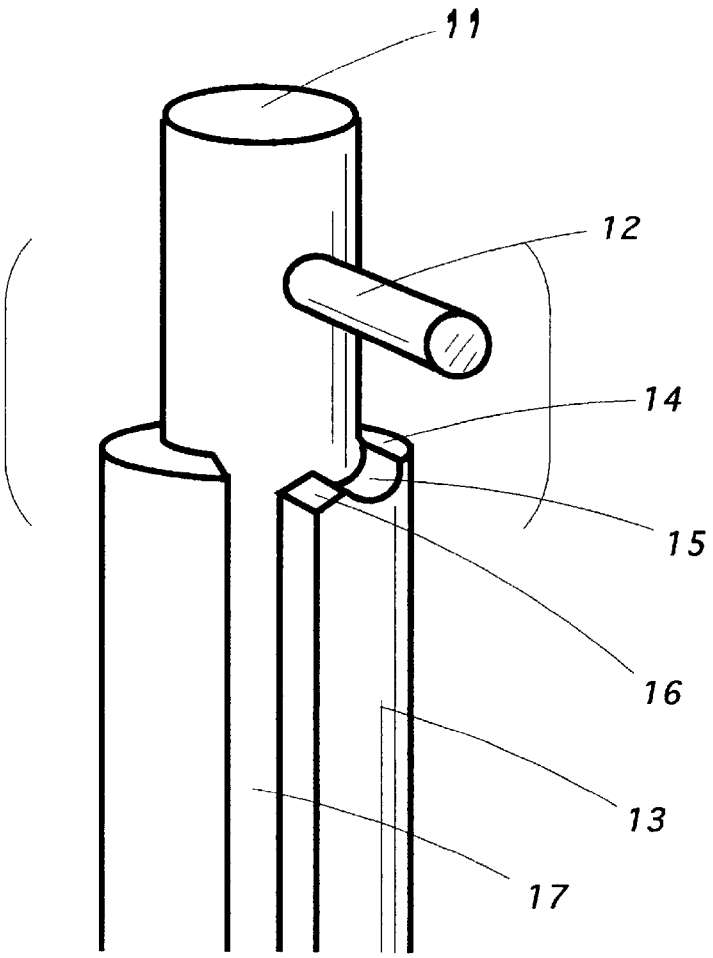
FIG. 3 comprises a view of part of the invention's bell ringing assembly (10) in which the tripping pin (12) is shown withdrawn from the pin notch (15).

In pivoting upon missile (102) impact, the tripping lever (2) strikes the tripping pin (12), the disposition of which is horizontal, proximate the lever (2) and in alignment with its (2) plane of rotation. The tripping pin (12) is thereby dislodged-knocked backwards from the rest (14) it until then occupied. The tripping pin drop channel (17) referred to supra is so disposed upon the hammer sleeve (13) that the pin (12) is directed into it (17). The hammer (11) comprises sufficient weight so that when the pin (12) attached to it (11) engages—or moves into—the channel (17), it (11) slips downward, guided therein (17) until it strikes the bell (19). Although not essential to the invention's function, a pin slide (16), shown in FIG. 3, facilitates this event. Since the pin (12) is attached to the hammer (11), its movement down the slide (16), if present, toward the channel (17) is facilitated by the pull of the hammer's (11) weight.

Thus, prior to activation, the hammer (19) is restrained from falling by the tripping pin's (12) emplacement upon the tripping pin rest (14) atop the sleeve (13). It is, therefore, necessary to reset the hammer (11) and pin (12) following each instance of use. Preferably, to prevent the pin's (12) premature dislodgement, the pin rest (14) comprises the tripping pin notch (15) referred to supra and shown in FIG. 3. The missile (102) must, of course, comprise sufficient weight to effect the foregoing tripping action. A common bean bag has been demonstrated adequate for such purpose for a properly disposed target tray (5) and lever (2).

As mentioned supra, the falling hammer (11) strikes the bell (19), thereby effectually announcing the fact that the target tray (5) has successfully been struck by the missile (102) thrown by the operator (100). As an entertainment feature, the bell (19) itself should be large enough to provide a loud clang, such as one in service for a fire department alarm.

As the hammer (11) falls, however, it simultaneously tugs the lanyard (7) tethered—or connected—to it (11). FIGS. 1 and 2 illustrate an eyelet (91) as a preferable lanyard tether (9) at the lanyard to hammer connection site (18).

The lanyard's (7) other end is tethered to the bucket tipping lever (24) at the lanyard to bucket connection site (23). It should, therefore, be observed that the hammer (11) of the bell ringing assembly (10) is tethered to the bucket tipping lever (24) of the dousing assembly (20). In the interest of manufacturing simplicity, the lanyard tether (9) merely comprises an aperture (92) through which the lanyard (7) is tied.

Figure 4:
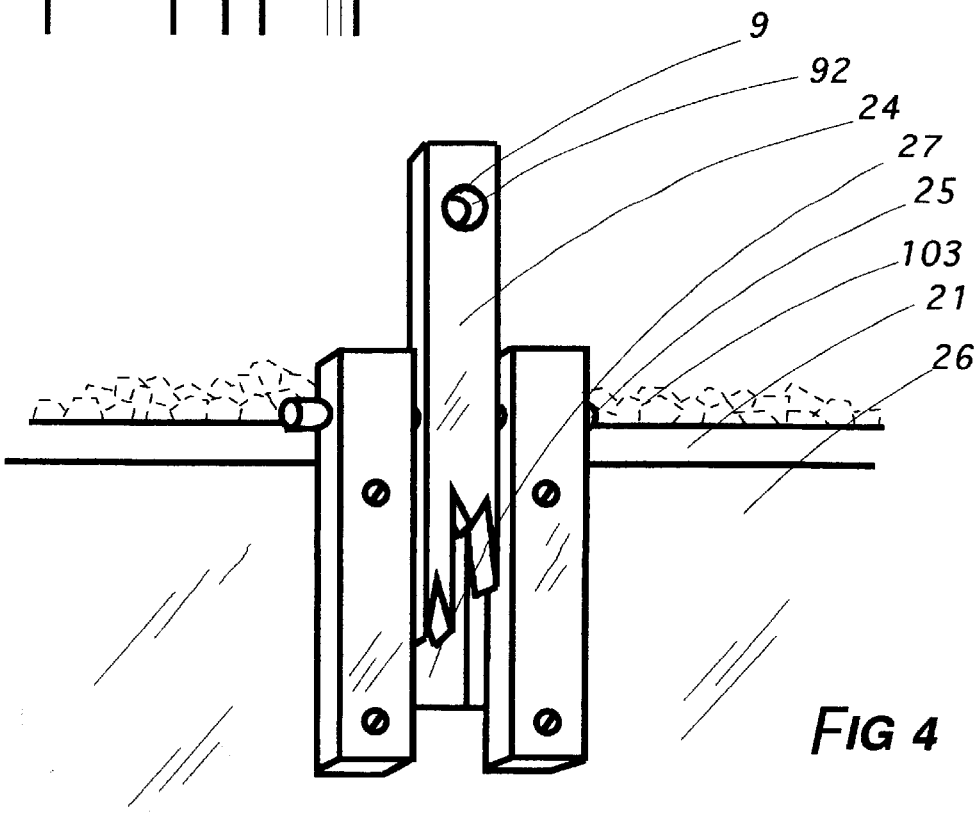
FIG. 4 illustrates a partially cut-away view of the bucket tipping lever (24), dousing enclosure (26) and dousing bucket (21).

Like the pin tripping lever (2) of the target assembly (1), the tipping lever (24) of the dousing assembly (20) is disposed upon a tipping pivot (25) disposed so as to provide any given plane of rotation. It is only necessary that the tipping lever (24) be brought in contact with the dousing bucket (21) so as to tip it (21) over to spill its contents (103). Thus, the plane of rotation may be disposed vertically, horizontally or in frontal angularity just as that of the pin tripping lever (2). For the same reasons given supra concerning disposition of the tripping lever (2), however, it is also preferred that the bucket tipping lever's (24) plane of rotation be vertical. Vertical rotation benefits from gravitational force and obviates resetting the lever (24) following actuation.

Where rotation is such that the lever (24) is pivotable in a vertical plane, it (24) is rotated downward upon its pivot (25) by the descending hammer (11) and its (24) unconnected end is rocked or swung through the tipping access window (27) disposed in the dousing enclosure (26) it (24) is disposed upon as shown in FIG. 4. That end is, thus, rotated upwards, striking the frontally disposed edge of the dousing bucket (21) with which it is disposed in proximity. The bucket (21) is so disposed that once it is (21) so knocked-or tipped—by the tipping lever (24), it (21) rotates backwards unimpeded upon its pivot (25), spilling its contents (103) upon the subject (200) below. Following each such instance of use, it is necessary to manually reset the bucket (21).

Summarizing the chain of events, once a missile strikes the target tray (5), the pin tripping lever (2) dislodges the tripping pin (12), allowing the hammer (11) to fall, striking the bell (1 9) and simultaneously pulling a second lever—the bucket tipping one (24) above—such that the dousing bucket is tipped over to dump its contents (103).

To reactuate the assembly thereafter, the tripping pin (12) is again emplaced atop the hammer sleeve (13) at the tripping pin rest (14) and the dousing bucket (21) refilled and reoriented within its enclosure (26).

To enhance the entertainment experienced in the invention's use, it is preferable that the subject (200) be in full view to the operator (100) throwing the missile (102) and that it (102) be thrown in the subject's (200) general direction. To avoid unintended injury, however, a transparent barrier (30) such as chicken mesh or screen should be erected between the operator (100) and the subject (200) to prevent injury from an errant missile (102). The target assembly (1), bell ringing assembly (10), dousing assembly (20), interconnecting lanyard (7) and barrier (30) are all disposed within an assembly frame (31) as illustrated in FIG. 1. The target enclosure (6), hammer sleeve (13), bell (19), lanyard sheath (8) and dousing enclosure (26) are all attached to and supported by the frame (3 1) by means familiar to prior art.

In a given embodiment, the movement of the target tray (5) may cause it (5) to complete an electric circuit in switch-like fashion. Prior art means are well known operable mechanisms other than those addressed by this invention by which an electromagnetic apparatus releases a retained object upon closing a switch. The target tray (5) may also activate more recently available prior art computer chip circuitry to accomplish that same end. A sophisticated prior art electric eye circuit may be employed wherein the circuit is opened upon the missile's passage through a given zone of light beam circuitry when impact with the tray (5) is impending.

The inventor hereby claims:

1. A target triggered dousing assembly comprising:

a target assembly, a bell ringing assembly and a dousing assembly;

the target assembly disposed at a missile impact site and comprising:

a target tray disposed upon a tripping pivot and comprising in turn an attached pin tripping lever; the bell ringing assembly comprising:

a hammer comprising in turn an attached tripping pin disposed proximate the tripping lever of the target assembly; and a bell;

the dousing assembly comprising:

a dousing bucket disposed upon a bucket pivot; and a bucket tipping lever disposed upon a tipping pivot;

the target triggered dousing assembly further comprising a lanyard disposed to tether the hammer of the bell ringing assembly to the tipping lever of the dousing assembly;

wherein the tripping lever, when target tray comprising it is impacted by a missile, is caused to dislodge the tripping pin of the bell ringing assembly, in turn causing the hammer thereof to fall, striking the bell and tugging the lanyard, causing the tethered tipping lever to tip the dousing bucket, dispelling its contents upon a participating subject below.

2. The target triggered dousing assembly according to claim 1 wherein the bell ringing assembly further comprises a hammer sleeve in turn comprising:

a tripping pin rest whereupon the tripping pin is disposed to lie until its dislodgment; and a drop channel wherein the pin is guided during the hammer's fall.

3. The target triggered dousing assembly according to claim 2 wherein the pin rest further comprises:

a tripping pin notch wherein the tripping pin is disposed to seat until its dislodgement; and a pin slide disposed to facilitate the pin's movement into the drop channel.

4. The target triggered dousing assembly according to claim 1 wherein the lanyard tether comprises one of:

an eyelet; and an aperture.

5. The target triggered dousing assembly according to claim 1 wherein tripping pin's dislodgment by the tripping lever is caused by vertical rotation of the target tray comprising the lever, so as to dispose the tripping pin upwards and backwards upon missile impact of the target tray 7.

6. The target triggered dousing assembly according to claim 1 wherein dousing bucket's tipping is caused by vertical rotation of the bucket tipping lever, so as to dispose the bucket to be rotated backwards upon the bucket pivot upon the lanyard's tugging by the falling hammer.

7. The target triggered dousing assembly according to claim 1 wherein the lanyard is disposed within a lanyard sheath.

8. The target triggered dousing assembly according to claim 1 further comprising a barrier; whereby the subject is protected from an errant missile.

9. The target triggered dousing assembly according to claim 1 wherein the target tray is disposed within a target enclosure and comprises a bull's eye and the dousing bucket is disposed within a dousing enclosure, both enclosures disposed within a supporting target triggered dousing assembly frame.

* * * * *